US005205836A

United States Patent [19]

Hansen et al.

[11] Patent Number: 5,205,836

[45] Date of Patent: Apr. 27, 1993

[54] FORMALDEHYDE-FREE TEXTILE FINISH

[75] Inventors: John H. Hansen; Phillip H. Riggins, both of Greensboro, N.C.

[73] Assignee: Burlington Industries, Inc., Greensboro, N.C.

[21] Appl. No.: 626,769

[22] Filed: Dec. 13, 1990

[51] Int. Cl.[5] ..... D06M 13/00

[52] U.S. Cl. ..... 8/120; 8/192; 8/194; 8/195; 8/196

[58] Field of Search ..... 8/120, 192, 194, 195, 8/196

[56] References Cited

U.S. PATENT DOCUMENTS

| | | | |
|---|---|---|---|
| 2,380,157 | 7/1945 | Dreyfus | 8/192 |
| 3,526,048 | 9/1970 | Rowland et al. | 8/120 |
| 3,575,209 | 4/1971 | Tesoro et al. | 8/120 |
| 4,936,865 | 6/1990 | Welch et al. | 8/120 |
| 4,975,209 | 12/1990 | Welch et al. | 8/120 |
| 5,042,980 | 4/1991 | Kitchens et al. | 8/120 |

*Primary Examiner*—Prince Willis, Jr.
*Assistant Examiner*—John F. McNally
*Attorney, Agent, or Firm*—Nixon & Vanderhye

[57] ABSTRACT

Durable press finishes are applied to cellulosic materials such as cotton by cross-linking a polycarboxylic acid within the cellulosic fibers using a cyanamide compound cross-linker devoid of phosphorus. Wrinkle-resistant, durable cellulosic materials free from formaldehyde odor result.

7 Claims, No Drawings

FORMALDEHYDE-FREE TEXTILE FINISH

This invention relates to compounds used to cross-link cellulose to impart durable press and wrinkle resistance characteristics to textile fabrics, primarily cellulose-containing fabrics, and specifically to the use of cyanamide compounds as phosphorus-free catalysts for curing butane tetracarboxylic acid (BTCA), a known cross-linking agent for cellulosic materials.

BACKGROUND OF THE INVENTION

Durable press characteristics are imparted to cellulose-containing fabrics by various cross-linking agents and resin formulations which cross-link the cellulose molecules. The widely-used cross-linking agents based upon formaldehyde are sometimes found objectionable for health and environmental reasons and attempts have therefore been made to replace them with formaldehyde-free cross-linkers. Butanetetracarboxylic acid (BTCA) is a carboxylic acid based resin investigated extensively in the cross-linking of cellulose for durable press resin finishes. Rowland and co-workers at the U.S. Department of Agriculture's Southern Regional Research Center have published widely on this subject.

U.S. Pat. No. 3,526,048 to Rowland et al refers to the cross-linking of cellulose with a variety of polycarboxylic acids, including BTCA, partially neutralized with an alkali metal hydroxide, ammonium hydroxide or an amine.

U.S. Pat. No. 4,820,307, to Welch et al, describes the reaction of cellulose with BTCA and a wide variety of other polycarboxylic acids, using a variety of phosphorus-containing catalysts, to produce durable press cellulosic fabrics.

WO 89/12714 (1989), also to Welch et al, describes the treatment of cellulose with a polycarboxylic acid and a "curing catalyst" selected from alkali metal hypophosphites (preferably), phosphites and polyphosphates.

These documents feature the use of phosphorus-containing catalysts, notably alkali hypophosphites, in fairly large amounts. The use of phosphorus-containing chemicals creates environmental concern in areas where phosphorus content of effluents must be carefully controlled.

We have discovered and hereby disclose a class of chemicals, described generally as cyanamide compounds, as more fully explained below, that effectively catalyze the formation of esters between polycarboxylic acids, including BTCA and other polycarboxylic acids that can be used in durable press finishes for cellulose-containing fabrics, and polyols like cellulose.

DESCRIPTION OF THE INVENTION

This invention provides a process for imparting wrinkle resistance and durable press properties to cellulosic textiles, without the use of formaldehyde or derivatives that release formaldehyde. The process is achieved by reacting a polycarboxylic acid with the fibrous cellulosic material in the presence of a cyanamide compound cross-linking catalytic agent and curing at elevated temperatures. An aqueous solution (or any other medium in which the components are dispersible or soluble) of the polycarboxylic acid and cyanamide cross-linker is applied to the textile to be treated, for example by padding onto the fabric from about 2 to about 8% of the polycarboxylic acid and about 1 to about 6% of the cyanamide compound cross-linking agent.

The process of this invention is suited to treating fibrous cellulosic material containing at least 30%, preferably 50%, cellulosic fibers such as jute, linen, flax, hemp, regenerated cellulose such as rayon, and, preferably cotton. The cellulosic material may be woven, non-woven or knit or in the form of fibers, linters, rovings, slivers, scrims or papers. The fibrous cellulosic material may consist entirely of cotton or cotton blended with a synthetic fiber such as polyester or nylon.

The concentration of the polycarboxylic acid used in the solution applied to the fabric is preferably from 2 to 10% by weight depending upon the solubility of the polycarboxylic acid, degree of durable press desired, nature and amount of the cross-linking agent and the like.

A fabric softener is also often present in the pad bath to adjust/soften the hand of the treated product. Suitable fabric softeners include nonionic polyethylenes, polypropylenes, silicones or other commercially available softeners.

The polycarboxylic acid may be an aliphatic, alicyclic and aromatic acid either olefinically saturated or unsaturated and having at least three carboxyl groups per molecule; an aliphatic, alicyclic and aromatic acid having two carboxyl groups per molecule and having a carbon-carbon double bond located alpha, beta to one or both of the carboxyl groups; an aliphatic acid either olefinically saturated or unsaturated and having at least three carboxyl groups per molecule and a hydroxyl group present on a carbon atom attached to one of the carboxyl groups of the molecule; or an aliphatic and alicyclic acid in which the acid contains an oxygen or sulfur atom in the chain or ring to which the carboxyl groups are attached; one carboxyl group being separated from a second carboxyl group by either two or three carbon atoms in the aliphatic and alicyclic acids; one carboxyl group being ortho to a second carboxyl group in the aromatic acids; and, one carboxyl group being in the cis configuration relative to a second carboxyl group where two carboxyl groups are separated by a carbon-carbon double bond or are both connected to the same ring, all as described by Welch et al in WO 89/12714.

Preferred polycarboxylic acids useful as durable press finishing agents include 1,2,3-propane-tricarboxylic acid, all-cis-1,2,3,4-cyclopentane-tetracarboxylic acid, citric acid, and, preferably butanetetracarboxylic acid. The polycarboxylic acid has at least three carboxyl groups located in the molecule and, when cured in the presence of a suitable cross-linking agent or agents, provides durable press properties to cellulosic and cellulose-containing fabrics and produces ester type cross-linkages formed within the cellulose fibers by the polycarboxylic acid. These ester linkages are mobile and thus provide fabrics that are recurable and creasable due to transesterification of adjacent hydroxyl groups of cellulose. The durable press fabrics so produced are odorless, unlike the formaldehyde-smelling products resulting from other procedures.

The fabrics treated by the process of this invention retain their durable press properties even following multiple home launderings. Durable press finishes based upon polycarboxylic acids cross-linked to the hydroxy groups on the cellulose fibers by the cyanamide compound cross-linking catalytic agent are prepared by the pad-dry-cure process in which an aqueous solution of the polycarboxylic acid(s) plus cyanamide compound catalyst and other adjuvants, as required, are applied to the fabric, the fabric is dried and cured at a suitable temperature, often in the range of 160° to 200° C. to form ester-type cross-linkages in the cellulose.

In the examples and illustrations that follow, properties of the finished fabrics were assessed using procedures established by the American Association of Textile Chemists and Colorists, AATCC Technical Manual 62, 1987 for durable press (DP) appearance ratings and the American Society for Testing and Materials, Committee D-13, ASTM Standards on Textile Materials, Philadelphia, Pa., 1980.

In addition to cyanamide itself, the cyanamide compound will be of the general formula:

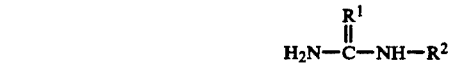

where $R^1$ is NH, O (oxygen) or S, and $R^2$ is CN or H. Thus, when $R^1$ is NH and $R^2$ is CN, the cyanamide compound is dicyandiamide; when $R^1$ is NH and $R^2$ is H, the cyanamide compound is guanidine; when $R^1$ is O and $R^2$ is H, the cyanamide compound is urea; and when $R^1$ is S and $R^2$ is H, it is thiourea. Among all of the cyanamide compounds encompassed by the general formula above, guanidine or a salt thereof, dicyandiamide, and cyanamide are the preferred catalysts.

The process of the present invention produces fabrics having commercially attractive wash/wear ratings after multiple home launderings, eliminates the formaldehyde odor of conventional resin-treated fabrics and avoids the presence of phosphorus in the treating fluid effluent.

The invention is further illustrated with reference to the following examples in which all parts and percentages are by weight unless otherwise indicated.

EXAMPLE 1

This shows the use of dicyandiamide as a catalyst, and compares it to the basic catalysis shown in the USDA patents.

Baths were prepared using butanetetracarboxylic acid, hereafter referred to as "BTCA," dicyandiamide, abbreviated as "DCDA", and a modified polyethylene fabric softener, PEG-75 from Sedgefield Specialties. These baths were padded onto swatches of cotton print cloth, 80×80 construction, ca. 3.1 oz./sq. yd., from Testfabrics, Inc. Wet pickups ranged from 68 to 72 percent by weight. Samples were dried/cured in a laboratory Mathis oven for two minutes at 175° or 190° C. The dried fabrics were laundered five times using hot water and Orvus detergent, then tumble-dried. Bath compositions, in weight percentages, and average wash-/wear ratings and shrinkage values after laundering are shown below:

| Bath Composition | | | Oven | Wash/ Wear | Shrinkage-% | |
|---|---|---|---|---|---|---|
| BTCA | DCDA | PEG-75 | Temperature | Rating | Warp | Fill |
| 8 | 6 | 1 | 170 | 2.5 | 0.6 | 0.5 |
| 8 | 6 | 1 | 190 | 2.5 | 0.7 | 0.5 |
| 8 | 3 | 1 | 170 | 2.5 | 0.6 | 0.1 |
| 8 | 3 | 1 | 190 | 2.5 | 0.5 | 0.2 |

Similar experiments were carried out with inorganic reagents. In this case, disodium phosphate (DSP) and sodium carbonate (SC) were the compounds used. Baths were applied to the same cotton fabric and wet pickups were in the 66–70 percent range. The samples were dried/cured at 185° C. for 2 minutes.

| Bath Composition | | | | Wash/Wear | Shrinkage-% | |
|---|---|---|---|---|---|---|
| BTCA | DSP | SC | PEG-75 | Rating | Warp | Fill |
| 8 | 5.3 | — | 1 | 2.8 | 0.8 | 0.5 |
| 8 | 2.7 | — | 1 | 2.2 | 0.8 | 0.6 |
| 8 | 2.7 | 2 | 1 | 2.2 | 1.1 | 1.1 |
| Water only | | | | 1.0 | 3.7 | 2.3 |

EXAMPLE 2

Additional samples were prepared as described in Example 1, using the same cotton fabric. Wet pickups were in the 66–69 percent range. Drying/curing was done for two minutes at 180° C.

| Bath Composition | | | | Wash/Wear | Shrinkage-% | |
|---|---|---|---|---|---|---|
| BTCA | DSP | SC | PEG-75 | Rating | Warp | Fill |
| 8 | 4 | — | 1 | 3.0 | 0.7 | 0.2 |
| 8 | 4 | 1 | 1 | 2.9 | 0.8 | 0.3 |
| 8 | 6 | 2 | 1 | 2.2 | 0.9 | 0.4 |
| 8 | 3 | — | 1 | 3.0 | 0.6 | 0.2 |
| 8 | 3 | 1 | 1 | 2.6 | 0.7 | 0.2 |
| 8 | 3 | 2 | 1 | 2.1 | 0.8 | 0.4 |

EXAMPLE 3

Additional samples were prepared as described in Example 1, using the same cotton fabric. Other compounds were used to increase linking of the BTCA and cellulose. These were urea, thiourea (TU), and guanidine carbonate (GC). GC does react with BTCA, releasing carbon dioxide and forming some carboxylate ions. In these tests, concentrated sulfuric acid (CSA) was added to baths to control the amount of carboxylate ion present. Wet pickups were in the 66–69 percent range. Drying/curing was done for two minutes at 180° C.

| Bath Composition | | | | | | | Wash/Wear | Shrinkage-% | |
|---|---|---|---|---|---|---|---|---|---|
| BTCA | DCDA | Urea | TU | GC | CSA | PEG-75 | Rating | Warp | Fill |
| 8 | 4 | — | — | — | — | 1 | 3.0 | 0.6 | 0 |
| 8 | — | 2.8 | — | — | — | 1 | 2.1 | 1.4 | 0.4 |
| 8 | — | — | 3.6 | — | — | 1 | 2.2 | 1.2 | 0.2 |
| 8 | — | — | — | 4.3 | 2.3 | 1 | 2.6 | 0.6 | 0 |
| 8 | — | — | — | 4.3 | 1.2 | 1 | 2.9 | 0.6 | +0.1 |

The experiment was repeated, using a second lot of the 80×80 cotton fabric. Wet pickups were in the 68–72% range. In this trial, the padded fabrics were stretched back to their original sizes after padding to simulate drying in the tenter frame. Drying/curing was done for two minutes at 180° C.

| Bath Composition | | | | | | | Wash/Wear | Shrinkage-% | |
|---|---|---|---|---|---|---|---|---|---|
| BTCA | DCDA | Urea | TU | GC | CSA | PEG-75 | Rating | Warp | Fill |
| 8 | — | — | — | — | — | 1 | 2.3 | 2.9 | 2.9 |
| 8 | 4 | — | — | — | — | 1 | 3.4 | 1.4 | 1.5 |
| 8 | — | 2.8 | — | — | — | 1 | 2.5 | 2.4 | 2.5 |
| 8 | — | — | 3.6 | — | — | 1 | 2.6 | 2.2 | 2.2 |
| 8 | — | — | — | 4.3 | 2.3 | 1 | 3.3 | 1.3 | 1.2 |
| 8 | — | — | — | 4.3 | 1.2 | 1 | 3.2 | 1.6 | 1.4 |
| 8 | — | — | — | 4.3 | — | 1 | 3.1 | 1.8 | 1.4 |

A similar trial was run, using cyanamide itself (Cy) as a catalyst. The new lot of fabric was used, padded samples were stretched back to the original shape, wet pickups were in the 68–72% range and drying/curing was done at 180° C. for two minutes.

| Bath Composition | | | | Wash/Wear | Shrinkage-% | |
|---|---|---|---|---|---|---|
| BTCA | DCDA | Cy | PEG-75 | Rating | Warp | Fill |
| 8 | 4 | — | 1 | 3.2 | 1.2 | 0.9 |
| 8 | — | 4.0 | 1 | 2.8 | 1.5 | 1.0 |
| 8 | — | 2.0 | 1 | 2.8 | 1.5 | 0.8 |

EXAMPLE 4

Baths were prepared and padded into a cotton jersey knit weighing about 5.85 oz./sq. yd. Wet pickups were in the 68–73 percent range. The padded, wet samples were first stretched to a standard shape, then dried/-cured in the Mathis oven at 180° C. for two minutes.

| Bath Composition | | | Shrinkage-% | |
|---|---|---|---|---|
| BTCA | DCDA | PEG-75 | Wales | Courses |
| 8 | 3 | 1 | 5.1 | 2.4 |
| 6 | 2.25 | 1 | 5.7 | 2.9 |
| 4 | 1.5 | 1 | 6.8 | 3.0 |
| Water only | | | 16.8 | 2.2 |

Baths were prepared and padded into a drapery fabric weighing about 4.95 oz./sq. yd. The fabric had polyester filament warp and cotton filling yarns, in about a 44/56 ratio by weight. Wet pickups were in the 56–58 percent range. The samples were dried/cured in the Mathis oven at 180° C. for two minutes. Laundering, with these samples, was done in warm water, rather than hot.

| Bath Composition | | | | | Shrinkage-% | |
|---|---|---|---|---|---|---|
| BTCA | DCDA | GC | CSA | PEG-75 | Warp | Fill |
| 4 | 1.67 | — | — | 1 | 1.4 | 0.9 |
| 4 | — | 1.33 | 0.33 | 1 | 1.6 | 1.6 |
| 4 | — | 1.33 | — | 1 | 1.5 | 1.6 |

EXAMPLE 5

Baths were prepared, using citric acid (CA) in place of BTCA. Baths were padded into the 80×80 cotton fabric. Wet pickups were in the 67–69 percent range. Drying/curing was done for two minutes at 180° C.

| Bath Composition | | | | Wash/Wear | Shrinkage-% | |
|---|---|---|---|---|---|---|
| CA | DCDA | SC | PEG-75 | Rating | Warp | Fill |
| 8 | 4 | — | 1 | 2.1 | 1.6 | 0.9 |
| 8 | 3 | — | 1 | 2.1 | 1.5 | 0.6 |
| 8 | 3 | 1 | 1 | 2.3 | 1.9 | 0.7 |
| 6 | 3 | — | 1 | 2.4 | 1.7 | 0.5 |

What is claimed is:

1. A process for treating and imparting durable wrinkle resistance to a cellulosic fibrous material, comprising the steps of:

(a) impregnating a cellulosic material with a treating solution containing a polycarboxylic acid selected from the group consisting of citric acid, tricarballylic acid, trans-aconitic acid, 1,2,3,4-butanetetracarboxylic acid, all-cis-1,2,3,4-cyclopentanetetracarboxylic acid, mellitic acid, oxydisuccinic acid and thiodisuccinic acid and a catalytic amount of a cyanamide compound selected from cyanamide or a compound of the formula

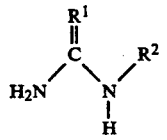

where $R^1$ is NH, oxygen or sulfur, and $R^2$ is CN or H, the polycarboxylic acid esterifying with the hydroxyl groups of the cellulosic material in the presence of the cyanamide catalyst; and (b) heating the material treated in step (a) to esterify and cross-link the cellulose with the polycarboxylic acid in the material.

2. The process of claim 1 where the cyanamide compound is selected from the group consisting of dicyandiamide, guanidine or a salt thereof, urea and thiourea.

3. The process of claim 1, in which the fibrous cellulosic material contains at least 30% cellulose selected from cotton, jute, flax, hemp, ramie or unsubstituted regenerated cellulose.

4. The process of claim 1, in which the cyanamide compound is dicyandiamide.

5. The process of claim 1 in which the cyanamide compound is guanidine or a guanidine salt.

6. The process of claim 1 in which the cyanamide compound is cyanamide.

7. The process of claim 1, in which the polycarboxylic acid is 1,2,3,4-butanetetracarboxylic acid, the cyanamide compound is guanidine or a guanidine salt, and the cellulosic fibers are cotton.

* * * * *